US010734762B2

(12) United States Patent
Kanemura et al.

(10) Patent No.: US 10,734,762 B2
(45) Date of Patent: Aug. 4, 2020

(54) CONNECTOR HOUSING AND CONNECTOR

(71) Applicant: Sumitomo Wiring Systems, Ltd., Yokkaichi, Mie (JP)

(72) Inventors: Keisuke Kanemura, Mie (JP); Teruo Hara, Mie (JP); Hidekazu Matsuda, Mie (JP); Ai Hirano, Mie (JP); Yuichi Nakanishi, Mie (JP); Shohei Mitsui, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/231,658

(22) Filed: Dec. 24, 2018

(65) Prior Publication Data

US 2019/0199036 A1 Jun. 27, 2019

(30) Foreign Application Priority Data

Dec. 26, 2017 (JP) ..... 2017-248729

(51) Int. Cl.

| | |
|---|---|
| ***H01R 13/639*** | (2006.01) |
| ***H01R 9/05*** | (2006.01) |
| ***H01R 13/50*** | (2006.01) |
| ***H01R 24/40*** | (2011.01) |
| ***H01R 13/436*** | (2006.01) |
| ***H01R 13/6582*** | (2011.01) |
| ***H01R 13/627*** | (2006.01) |

(52) U.S. Cl.

CPC ..... *H01R 13/639* (2013.01); *H01R 9/05* (2013.01); *H01R 13/4362* (2013.01); *H01R 13/50* (2013.01); *H01R 13/6272* (2013.01); *H01R 13/6582* (2013.01); *H01R 24/40* (2013.01)

(58) Field of Classification Search

CPC .. H01R 13/639; H01R 13/4362; H01R 13/50; H01R 13/6582; H01R 9/05; H01R 24/40; H01R 13/627

See application file for complete search history.

(56) References Cited

U.S. PATENT DOCUMENTS

| | | | | |
|---|---|---|---|---|
| 4,950,179 A * | 8/1990 | Takenouchi | ..... | H01R 13/6272 439/352 |
| 4,986,766 A * | 1/1991 | Leonard | ..... | H01R 13/6272 439/352 |
| 5,030,127 A * | 7/1991 | Blasko | ..... | H01R 13/6272 439/353 |
| 5,192,225 A * | 3/1993 | Suzuki | ..... | H01R 13/6272 439/350 |

(Continued)

FOREIGN PATENT DOCUMENTS

JP 2001-319732 11/2001

*Primary Examiner* — Edwin A. Leon
*Assistant Examiner* — Milagros Jeancharles
(74) *Attorney, Agent, or Firm* — Gerald E. Hespos; Michael J. Porco; Matthew T. Hespos

(57) ABSTRACT

A connector housing (20) includes a housing body (21) to which a mating connector housing is to be fit from front. A lock arm (40) has front and rear ends fixed to the housing body (21). A lock (42) is provided in a central part of the lock arm (40) in the front-rear direction and is configured to lock the mating connector housing. A pressing surface (43) is on a rear end part of the lock arm (40) and is configured to displace the lock (42) in an unlocking direction by being pressed. A coupling portion (44) couples the pressing surface (43) to the central part of the lock arm (40) in the front-rear direction.

7 Claims, 7 Drawing Sheets

(56) References Cited

U.S. PATENT DOCUMENTS 5,234,356 A * 8/1993 Maejima ..... H01R 13/6272 439/352
5,246,380 A * 9/1993 Kodama ..... H01R 13/6272 24/616
5,254,014 A * 10/1993 Yagi ..... H01R 13/6272 439/353
5,295,855 A * 3/1994 Walz ..... H01R 13/6272 285/319
5,507,666 A * 4/1996 Yamanashi ..... H01R 13/641 439/354
5,584,719 A * 12/1996 Tsuji ..... H01R 13/6272 439/354
5,664,961 A * 9/1997 Tsuji ..... H01R 13/6272 439/353
5,690,503 A * 11/1997 Konda ..... H01R 13/6276 439/348
5,873,747 A * 2/1999 Tsuji ..... H01R 13/6272 439/357
5,980,297 A * 11/1999 Sugie ..... H01R 13/6272 439/353
5,993,238 A * 11/1999 Kudo ..... H01R 13/6272 439/352
6,364,685 B1 * 4/2002 Manning ..... G02B 6/3879 439/354
6,676,433 B1 * 1/2004 Ozaki ..... H01R 13/5025 439/350
6,908,329 B2 * 6/2005 Kozono ..... H01R 13/641 439/352
7,066,768 B2 * 6/2006 Kameyama ..... H01R 24/44 439/568
7,214,080 B2 * 5/2007 Ichio ..... H01R 13/6272 439/246
7,402,069 B2 * 7/2008 Shigeta ..... H01R 13/641 439/352
7,677,936 B2 * 3/2010 Sato ..... H01R 13/506 439/357
8,777,651 B2 * 7/2014 Miyawaki ..... H01R 13/6272 439/354
9,742,115 B2 * 8/2017 Matsumoto ..... H01R 13/6272
9,923,297 B2 * 3/2018 Sekino ..... H01R 13/627
10,297,932 B2 * 5/2019 Maesoba ..... H01R 13/6477
10,305,221 B2 * 5/2019 Ohfuku ..... H01R 13/641
10,490,922 B2 * 11/2019 Takase ..... H01R 13/42
10,601,153 B2 * 3/2020 Maki ..... H01R 24/42
2002/0031929 A1 * 3/2002 Torii ..... H01R 13/641 439/159
2006/0166544 A1 * 7/2006 Tateishi ..... H01R 13/6272 439/358
2008/0182448 A1 * 7/2008 Glaser ..... H01R 13/6272 439/352
2009/0186524 A1 * 7/2009 Maesoba ..... H01R 13/4223 439/595
2013/0059457 A1 * 3/2013 Hori ..... H01R 13/62933 439/270

* cited by examiner

CONNECTOR HOUSING AND CONNECTOR

BACKGROUND

Field of the Invention

The invention relates to a connector housing and a connector.

Related Art

A connector housing conventionally includes a housing body with a front end and a mating connector housing is fit to the housing body from the front. The housing has a lock arm for locking the mating connector housing in a properly connected state. For example, Japanese Unexamined Patent Publication No. 2001-319732 discloses a connector housing with a lock arm supported at opposite front and rear ends to a housing body. The support of the lock arm on both ends reduces rattling in the front-rear direction at the time of connection to a mating connector housing as compared to a cantilevered lock arm. A lock protrusion is provided on the upper surface of this lock arm at a position somewhat closer to a front end than a central part in the front-rear direction. An operating piece for an unlocking operation projects at a position slightly behind the lock protrusion. The operating piece is disposed outside a receptacle of the mating connector housing in a properly connected state of a connector, and the lock arm is displaced resiliently down for unlocking by pressing the operating piece down.

However, in the configuration described above, the operating piece is near the receptacle of the mating connector housing in the properly connected state of the connector. Thus, it is difficult to press only the operating piece. An operating piece on a rear part (near a fixed end) of the lock arm would be easier to access but would be require a greater force to be exerted to deflect the lock arm in the unlocking direction. Therefore, ingenuity for improving an unlocking operation has been desired.

The invention was completed on the basis of the above situation and aims to provide a connector housing and a connector capable of improving an unlocking operation.

SUMMARY

A connector housing of the invention includes a housing body to which a mating connector housing is to be fit from the front. A lock arm has both end parts in a front-rear direction fixed to the housing body. A central part of the lock arm in the front-rear direction has a locking portion configured to lock the mating connector housing. A pressing surface is disposed on a rear end part of the lock arm. The pressing surface is configured to displace the locking portion in an unlocking direction by being pressed. A coupling portion couples the pressing surface to the central part of the lock arm in the front-rear direction.

A connector of the invention includes the above-described connector housing and a terminal fitting accommodated in the housing body.

The lock arm can be displaced easily in the unlocking direction by pressing the pressing surface disposed on the rear end part of the lock arm. Thus, the ease of an unlocking operation can be improved.

The coupling portion of one embodiment includes two arms coupled to both left and right sides of the lock arm, and the pressing surface extends to the arms. According to this configuration, a large width of the pressing surface is ensured. Thus, fingers can be placed on the pressing surface more easily and, hence, the unlocking operation is facilitated.

The pressing surface may have a cutout configured to allow the rear end part of the lock arm to escape when the pressing surface is pressed. Thus, a deflection space for the lock arm can be smaller, and a height reduction of the connector housing can be realized.

The housing body may have a protecting portion that covers a side of the lock arm opposite to the unlocking direction in an intermediate part of the lock arm in the front-rear direction, and the pressing surface may be located behind the protecting portion. Thus, the intermediate part of the lock arm in the front-rear direction cannot be pressed inadvertently in the unlocking direction, while still permitting the pressing surface to be pressed easily.

The terminal fitting may be a coaxial terminal to be connected to an end of a coaxial cable. A coaxial connector that rattles in a properly connected state causes a characteristic impedance disturbance and affects a high frequency characteristic of the coaxial cable. However, according to this configuration, the lock arm of the connector housing is supported on both ends. Thus, the rattling of the connector in the properly connected state is reduced for advantageously suppressing a high frequency characteristic variation.

DETAILED DESCRIPTION

An embodiment of the invention is described in detail with reference to FIGS. 1 to 8.

Figure 1:
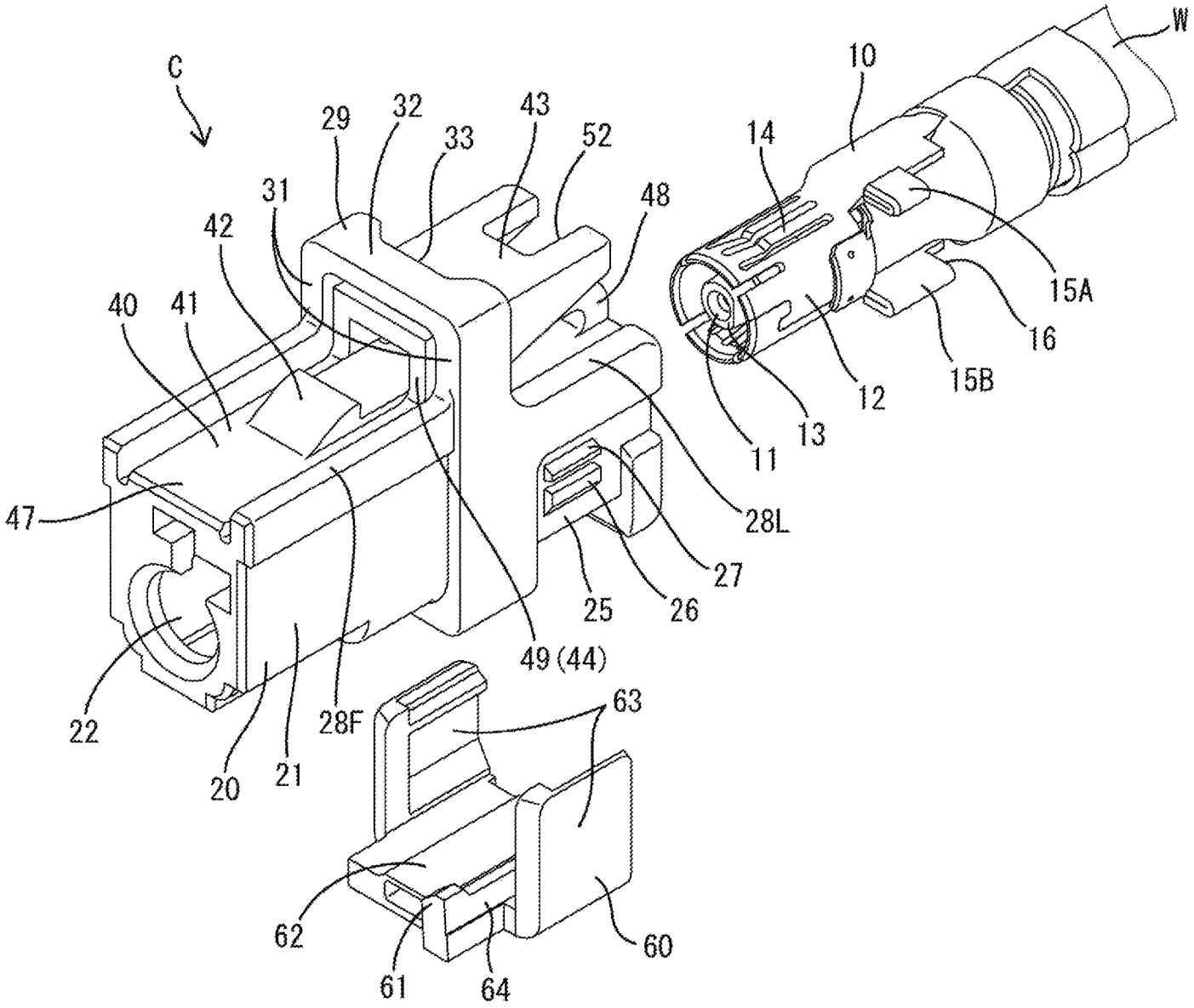
FIG. 1 is an exploded perspective view of a connector in an embodiment.

A connector C in this embodiment includes a terminal fitting 10 connected to an end part of a cable W and a connector housing 20 for accommodating the terminal fitting 10. The connector C is a female connector connectable to an unillustrated mating male connector. In the following description, in each constituent member, a connection surface (left-front of FIG. 1) of the connector C to a mating connector is referred to as a front, an opposite side (right-back of FIG. 1) is referred to as a rear, and an upper side (side where a lock arm 40 is provided) and a lower side of FIG. 1 are referred to as an upper side and a lower side.

The cable W is a coaxial cable including a conductive center conductor, an insulating coating surrounding the outer periphery of the center conductor, a conductive shield layer surrounding the outer periphery of the coating and an insulating sheath surrounding the outer periphery of the shield layer. The center conductor is a twisted wire or the like formed by twisting plural strands, and the shield layer is a braided wire or the like formed by weaving strands into a net. The center conductor transmits a high-frequency signal and the shield layer shields electromagnetic waves. The cable W has the sheath and the coating stripped to successively expose the center conductor and the shield layer from a tip side.

The terminal fitting 10 is a coaxial terminal connected to an end part of the coaxial cable and includes an inner conductor (not shown) to be crimped and connected to the center conductor and the coating of the cable W, an outer conductor 12 to be crimped and connected to the shield layer and the sheath, and a dielectric 11 made of an insulating synthetic resin and disposed between the inner conductor and the outer conductor 12.

The inner conductor is long and narrow in the front-rear direction and may be formed by bending a metal plate. A connecting portion is provided on a front part of the inner conductor and connects to an inner conductor of a mating terminal fitting. The connecting portion is on a back side of an insertion hole 13 of the dielectric 11. The outer conductor 12 is a tube with a circular cross-section one size larger than the inner conductor and may be formed by bending a metal plate. The outer conductor 12 has a contact portion 14 configured to resiliently contact an outer conductor of the mating terminal fitting.

The terminal fitting 10 has upper and lower stabilizers 15A, 15B provided respectively on upper and lower ends of the terminal fitting 10 in a vertical direction. The stabilizers 15A, 15B project in the same direction (left in this embodiment) from the terminal fitting 10. Each stabilizer 15A, 15B is integral to the outer conductor 12, is a plate formed by doubly folding a metal plate of the outer conductor 12, and has plate surfaces substantially perpendicular to the vertical direction.

A locking lance 23 and a retainer 60 of the connector housing 20 to be described later are locked respectively to the stabilizers 15A, 15B. The rear end of each stabilizer 15A, 15B defines a lock receiving surface 16 substantially perpendicular to the front-rear direction. The locking lance 23 is locked to the upper stabilizer 15A in FIG. 1 and the retainer 60 is locked to the lower stabilizer 15B. The upper stabilizer 15A is shorter in the front-rear direction than the lower stabilizer 15B. Note that the front ends of the stabilizers 15A, 15B are at substantially the same position in the front-rear direction, and the rear ends (lock receiving surfaces 16) are shifted in the front-rear direction.

The connector housing 20 is made of synthetic resin and includes a housing body 21 to which the mating connector housing is to be fit from the front. The connector housing 20 also has a lock arm 40 for holding the mating connector housing in a locked state by locking the mating connector housing that has reached a properly connected state.

The housing body 21 can fit into a receptacle of the mating connector housing. The housing body 21 is in the form of a tube long in the front-rear direction, and a terminal accommodation chamber 22 penetrates through the housing body 21 in the front-rear direction for accommodating the terminal fitting 10. The terminal accommodation chamber 22 is shaped in conformity with the outer shape of the terminal fitting 10, and the terminal fitting 10 is insertable therein from behind.

Figure 2:
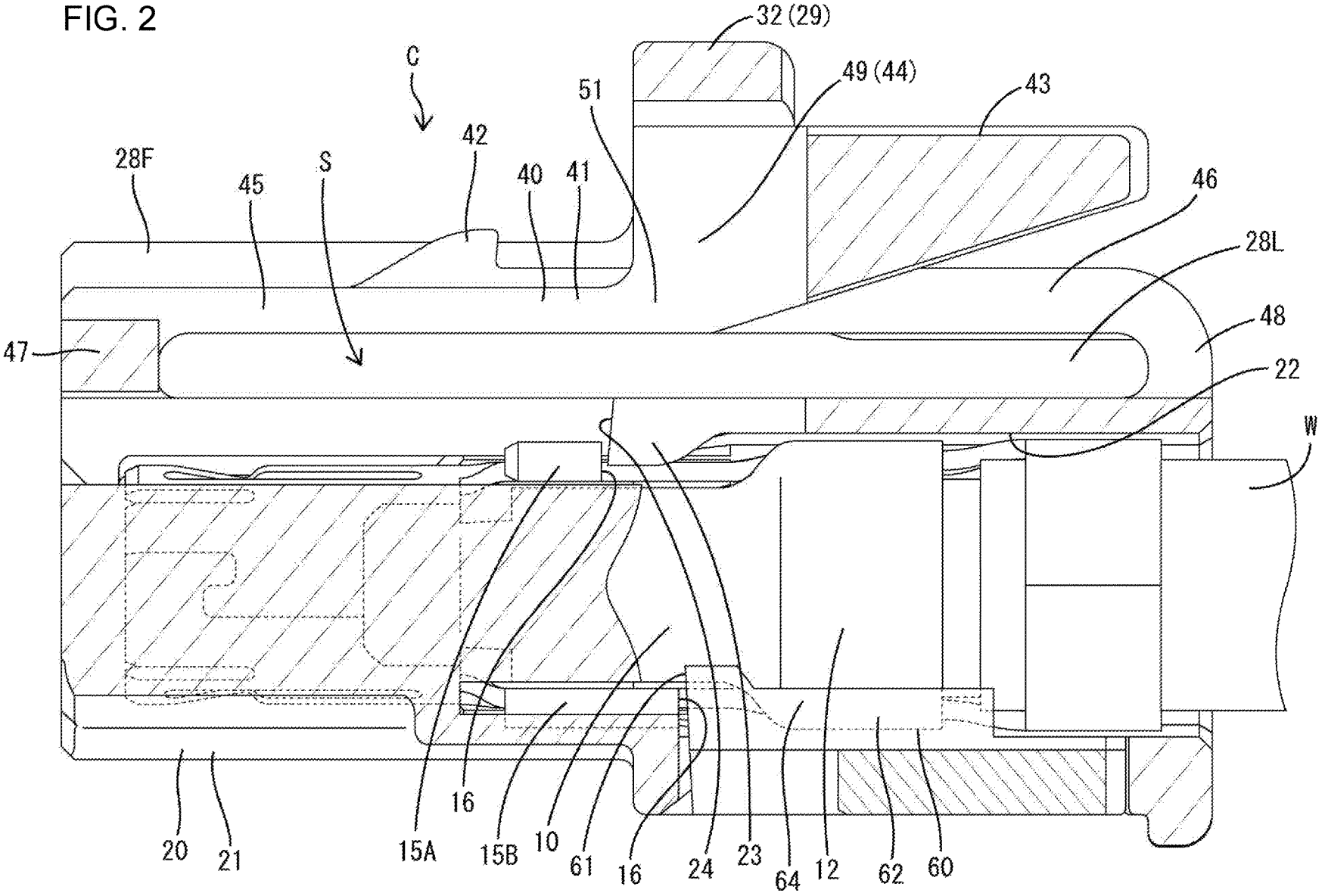
FIG. 2 is a section showing the connector.
Figure 3:
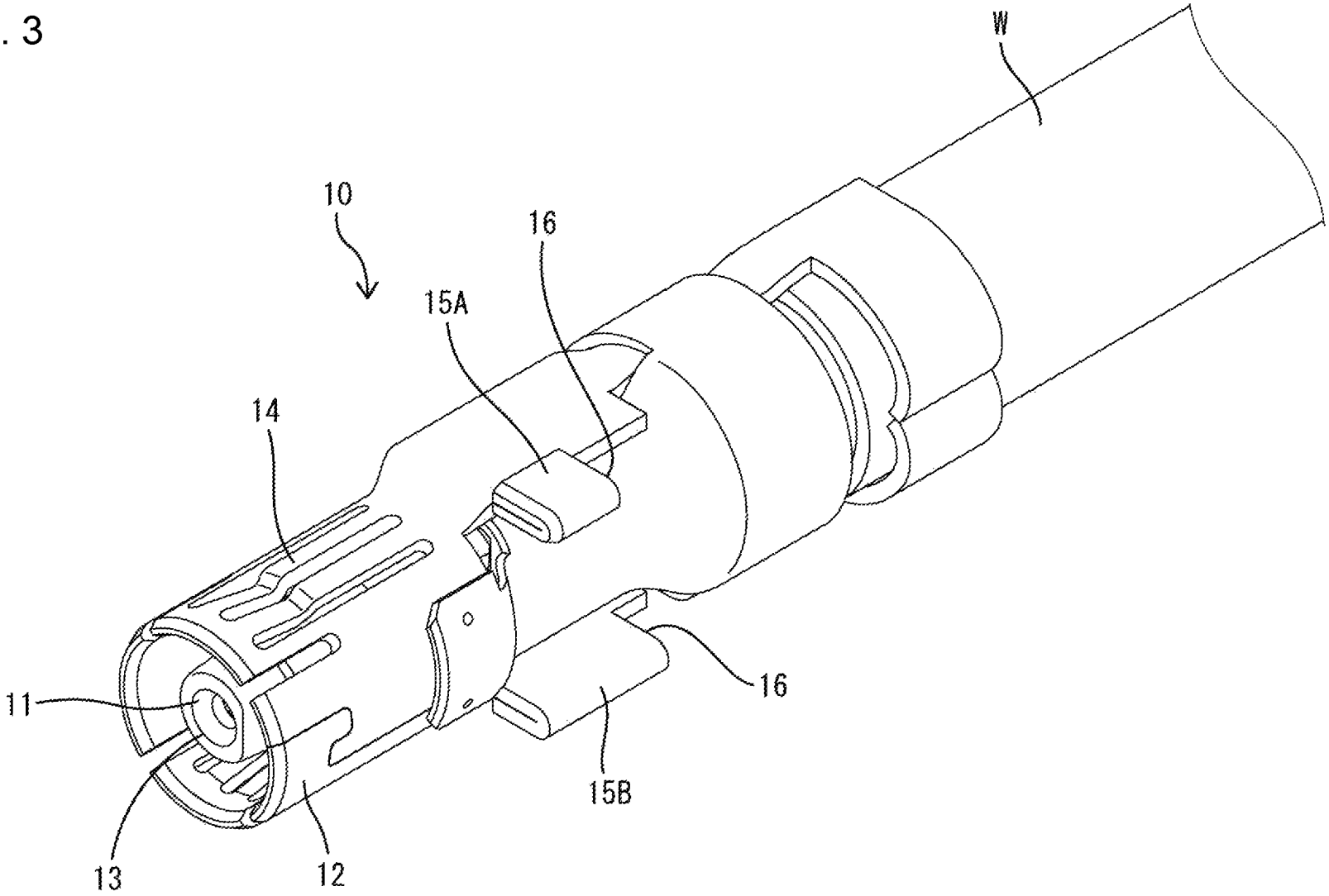
FIG. 3 is a perspective view showing a coaxial terminal.
Figure 4:
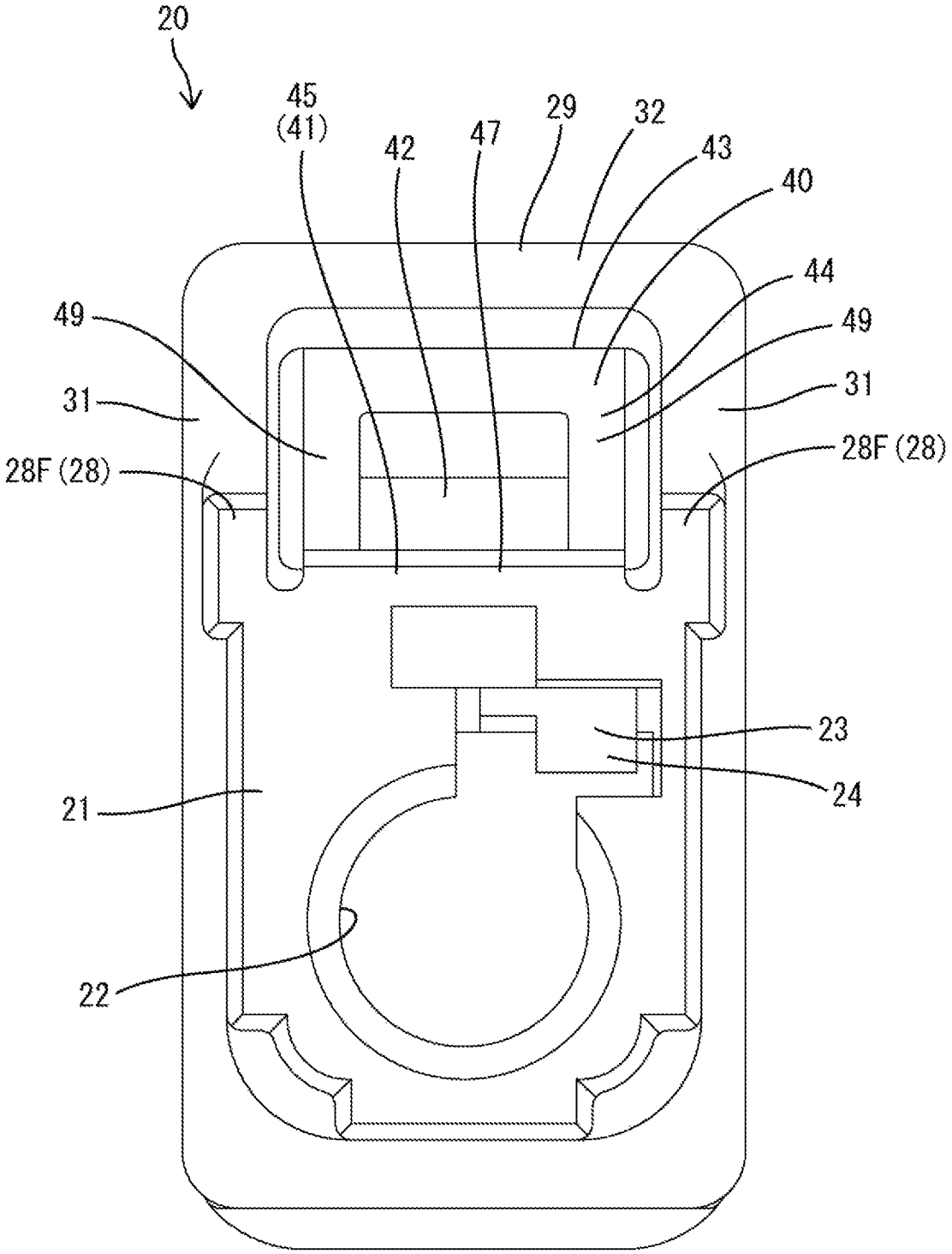
FIG. 4 is a front view showing a connector housing.

As shown in FIG. 2, the locking lance 23 is cantilevered forward in the terminal accommodation chamber 22 and locks the terminal fitting 10 that has been inserted to a proper position. A tip (front end) of the locking lance 23 projects into the terminal accommodation chamber 22, and the front surface of the locking lance 23 serves as a locking surface 24 to be locked to the terminal fitting 10. As shown in FIG. 4, the locking lance 23 is at a position near one side in a lateral direction of the terminal accommodation chamber 22.

As shown in FIG. 2, the retainer 60 for locking the terminal fitting 10 is mounted in the housing body 21. A retainer mounting portion 25 into which the retainer 60 is to be mounted is open in the lower surface of the housing body 21 and communicates with the terminal accommodation chamber 22. As shown in FIG. 1, the retainer mounting portion 25 includes partial locking portions 26 and full locking portions 27 for locking the retainer 60. The partial locking portion 26 and the full locking portion 27 project one above the other on each of both left and right side surfaces of the housing body 21.

The retainer 60 is made of synthetic resin and includes a retainer body 62 having a locking surface 61 to be locked to the terminal fitting 10, and two locking plates 63 to be locked to the housing body 21. The retainer body 62 is a flat rectangular plate for closing a lower opening of the retainer mounting portion 25. The locking plates 63 rise up from both left and right ends of the retainer body 62.

The locking plates 63 can be locked to the partial locking portions 26 of the housing body 21 to hold retainer 60 at a partial locking position where the locking surface 61 is retracted from the terminal accommodation chamber 22 and the terminal fitting 10 can be inserted and withdrawn. Further, the locking plates 63 can be locked to the full locking portions 27 of the housing body 21 to hold the retainer 60 at a full locking position where the locking surface 61 enters the terminal accommodation chamber 22 to retain the terminal fitting 10.

As shown in FIG. 1, the locking surface 61 is at a position projecting forward on the front surface of the retainer body 62. Further, the locking surface 61 rises substantially perpendicularly to the upper surface of the retainer body 62. The locking surface 61 is at a position near one end side in a lateral direction of the retainer body 62. A ridge 64 projects on the upper surface of the retainer body 62 behind a rear side of the locking surface 61 and defines a rib long in the front-rear direction.

Figure 6:
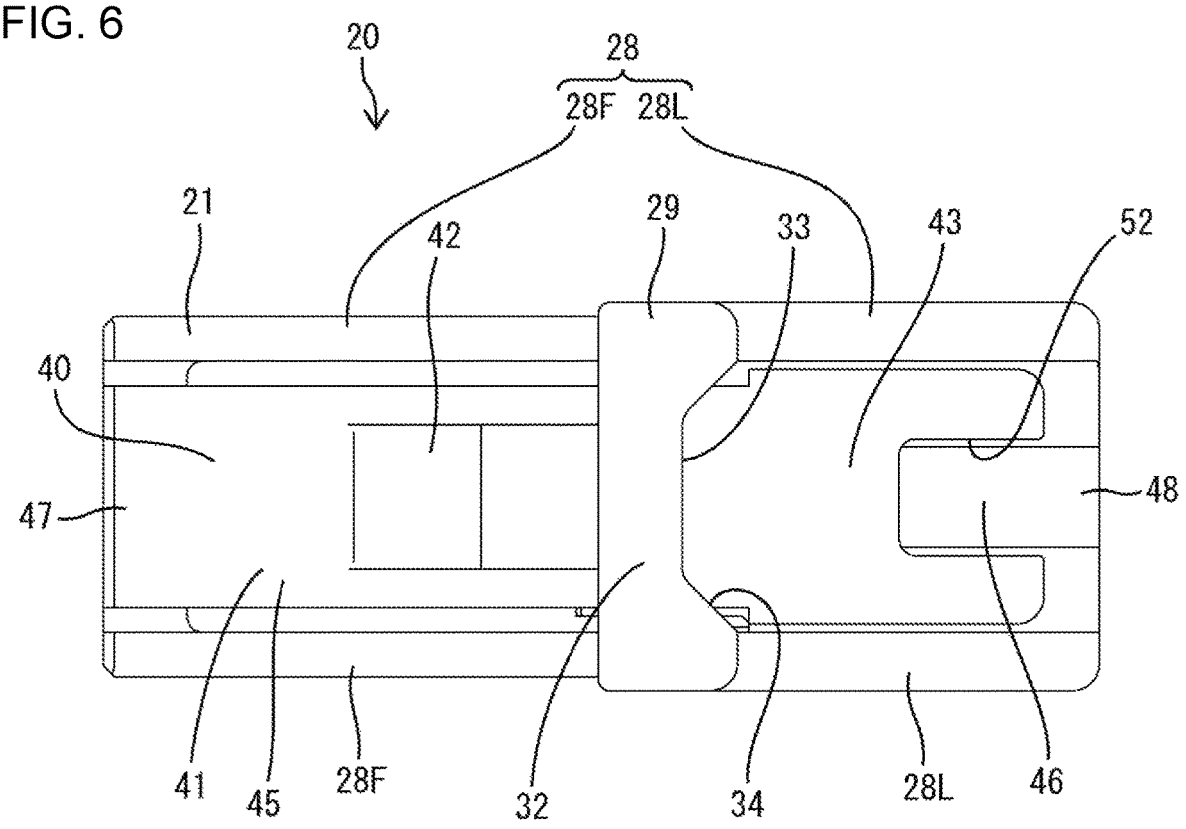
FIG. 6 is a plan view showing the connector housing.
Figure 7:
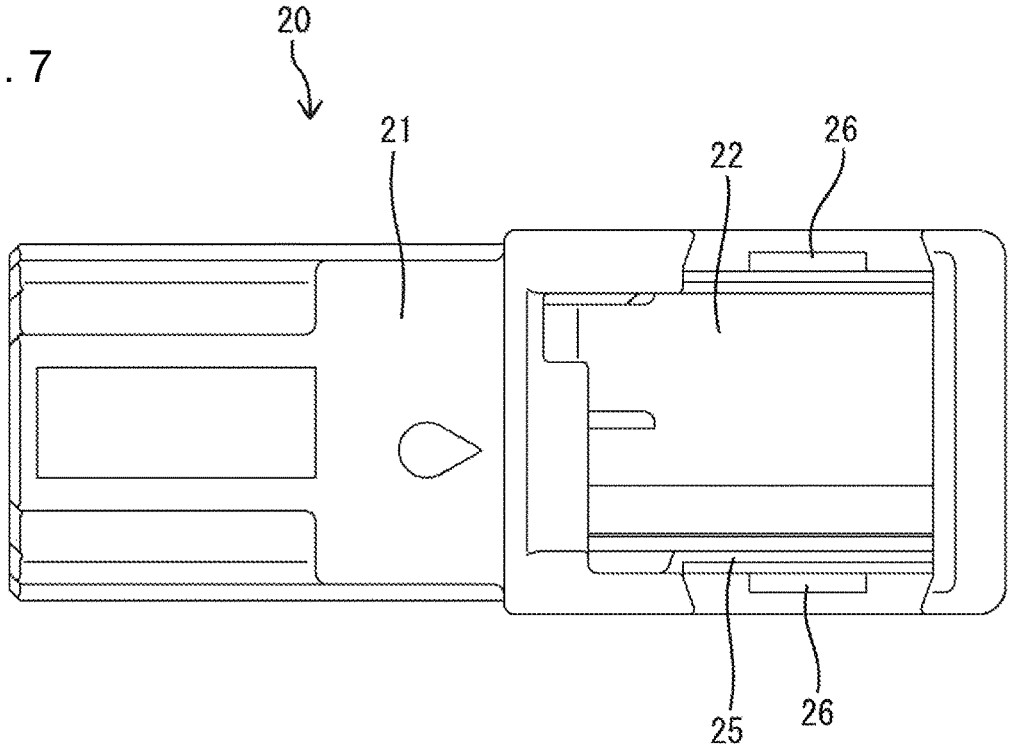
FIG. 7 is a bottom view showing the connector housing.

As shown in FIG. 6, ribs 28 stand along left and right side edges of the upper surface of the housing body 21. The ribs 28 extend in the front-rear direction over substantially the entire length of the housing body 21. Each rib 28 includes a front rib 28F and a rear rib 28L. The front rib 28F is before a protecting portion 29 to be described later and is higher than the rear rib 28L behind the protecting portion (see FIG. 8).

The lock arm 40 is supported on both ends on the upper surface of the housing body 21 and is configured to hold the connector in a properly connected state by resiliently locking the mating connector housing. As shown in FIG. 2, the lock arm 40 includes a lock arm body 41 having both ends in the front-rear direction fixed to the housing body 21, a lock 42 provided on the upper surface of the lock arm body 41, a pressing surface 43 provided on an upper rear part of the lock arm body 41 and a coupling portion 44 coupling the pressing surface 43 and the lock arm body 41.

As shown in FIG. 2, the lock arm body 41 extends from the front end to the rear end of the housing body 21. As shown in FIG. 1, the lock arm body 41 has a front end fixing portion 47 coupled between the front ribs 28F on the upper surface of the housing body 21. The front end fixing portion 47 has a width substantially equal to a spacing between the front ribs 28F. The lock arm body 41 also has a rear end fixing portion 48 coupled between the rear ribs 28L on the upper surface of the housing body 21.

A substantially front half of the lock arm body 41 defines a wide portion 45 in the form of a flat plate having a relatively large width and a substantially rear half defines a narrow portion 46 having a relatively small width, as shown in FIG. 6. As shown in FIG. 2, a vertical thickness of the wide portion 45 is smaller than a vertical thickness of the narrow portion 46, and the upper surface of the wide portion 45 is lower than that of the narrow portion 46 on the upper surface of the lock arm body 41. The upper surface of the wide portion 45 is located below upper surfaces of the front ribs 28F, and the upper surface of the narrow portion 46 is located above upper surfaces of the rear ribs 28L. The lower surface of the lock arm body 41 is flat without any step from the wide portion 45 to the narrow portion 46. A deflection space S is formed below the lock arm body 41 and has a constant vertical dimension in its entirety. Note that the upper surfaces of the rear ribs 28L are below the lower surface of the narrow portion 46.

As shown in FIG. 2, the lock 42 is slightly closer to the front end than a center of the lock arm body 41 in the front-rear direction. The lock 42 projects on the upper surface of the lock arm body 41. The front surface of the locking portion 42 is inclined so that a projecting dimension gradually increases from a front end toward a rear end, and the rear surface is an upright surface substantially perpendicular to the front-rear direction. A width of the locking portion 42 is equal to the width of the narrow portion 46.

The pressing surface 43 is on a rear part of the lock arm 40 and can be pressed to displace the locking portion 42 in an unlocking direction. As shown in FIG. 2, the pressing surface 43 is horizontal and substantially perpendicular to the unlocking direction of the lock arm 40. A width of the pressing surface 43 is slightly larger than the width of the wide portion 45, as shown in FIG. 6. The rear end of the pressing surface 43 is above the rear end fixing portion 48 of the lock arm body 41.

The pressing surface 43 is formed with a cutout 52 for allowing the rear end fixing portion 48 of the lock arm body 41 to escape when the pressing surface 43 is pressed (see FIG. 6). The cutout 52 is open rearward and has a rectangular shape. A width of the cutout 52 is so set that the rear end fixing portion 48 can enter from below.

Figure 5:
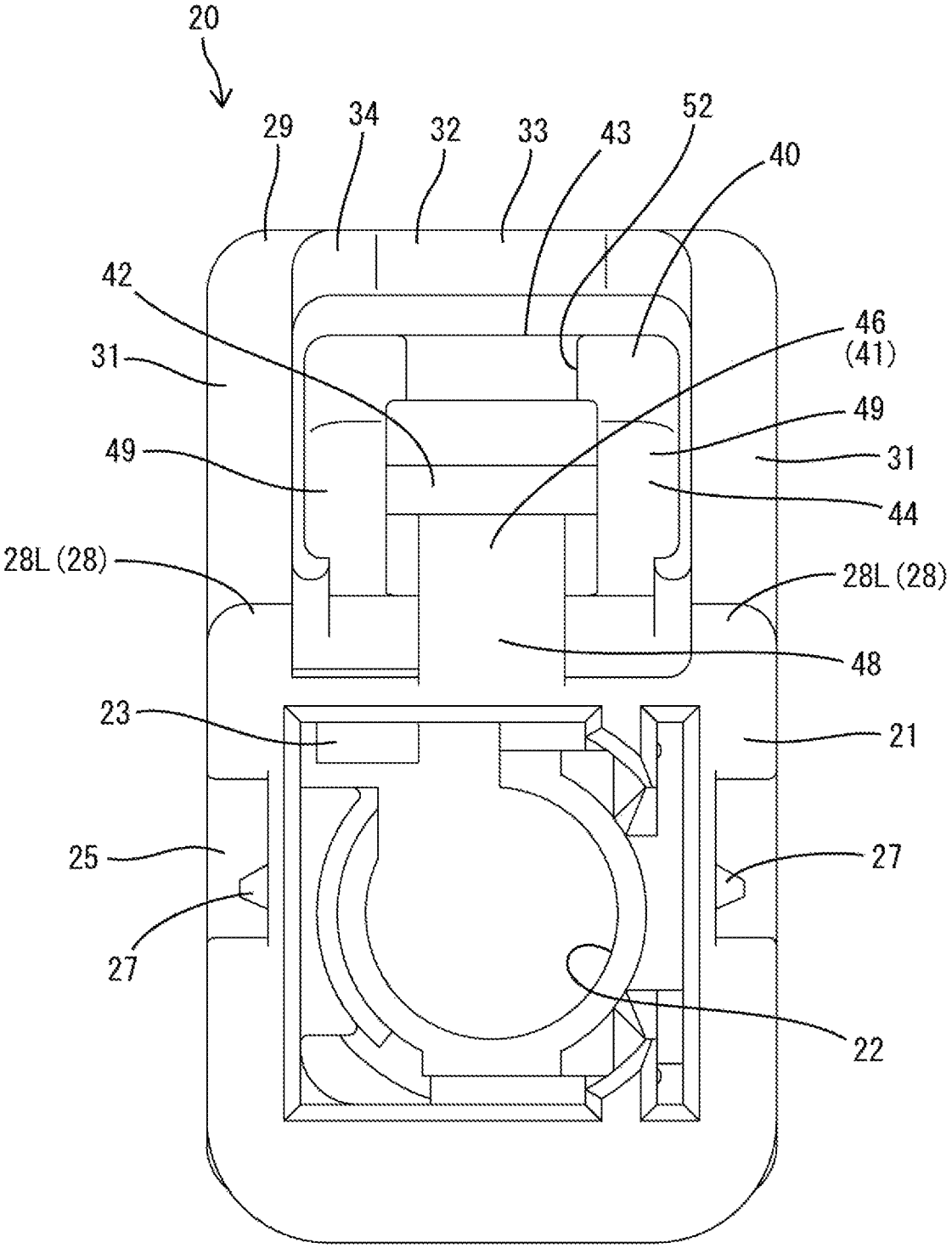
FIG. 5 is a back view showing the connector housing.

As shown in FIG. 2, the coupling portion 44 couples the pressing surface 43 to a central part of the lock arm 40 in the front-rear direction. As shown in FIG. 5, the coupling portion 44 includes two arms 49 coupled respectively to left and right sides of the lock arm 40. The pressing surface 43 extends to the arms 49 and the upper surfaces of the arms 49 form parts the pressing surface 43.

Figure 8:
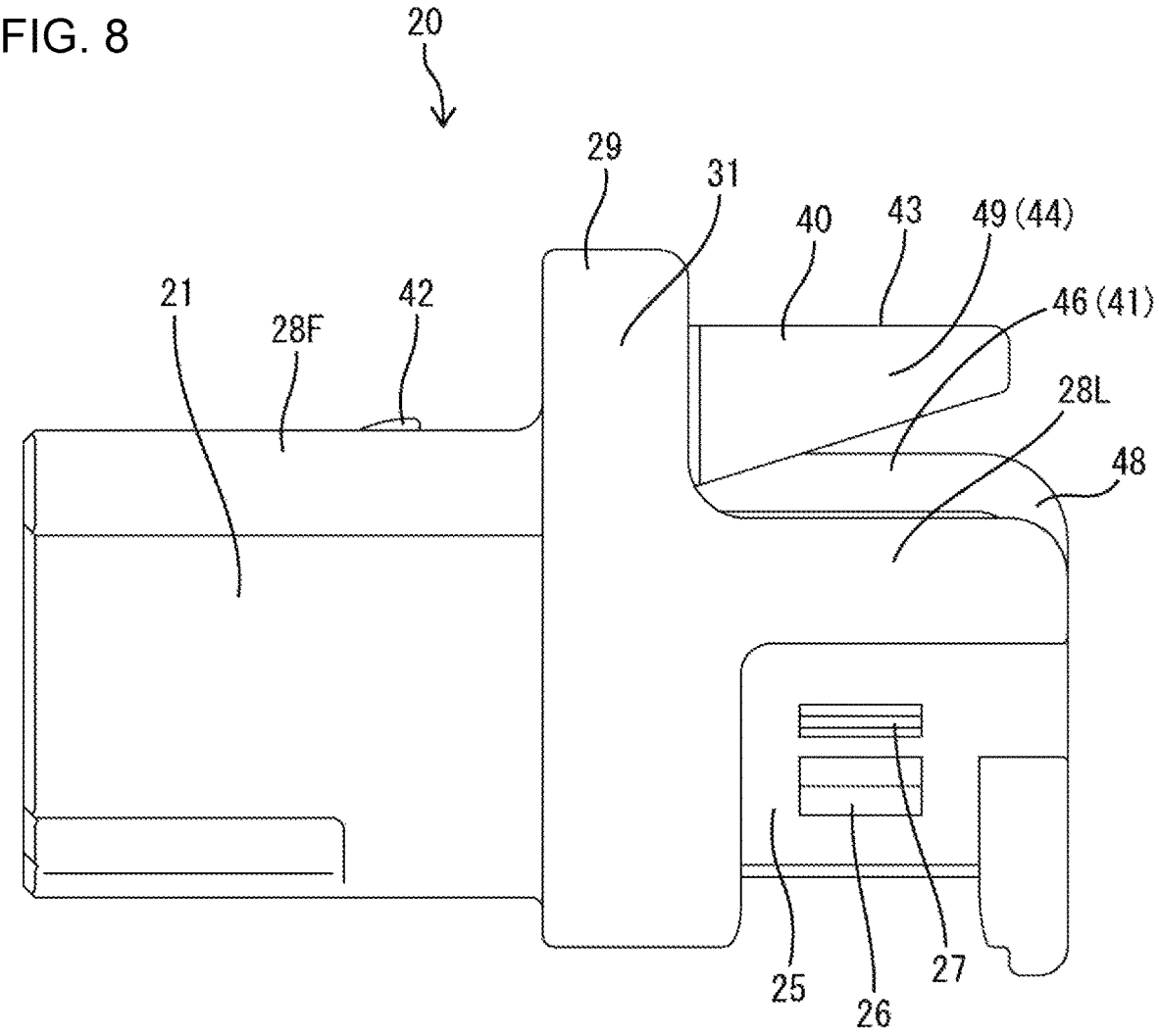
FIG. 8 is a side view showing the connector housing.

As shown in FIG. 8, the arms 49 form walls rising up on both left and right sides of the narrow portion 46 of the lock arm body 41. Front parts of the arms 49 are coupled respectively to left and right side surfaces of the narrow portion 46 and the rear surface of the wide portion 45. Sides of the arms 40 behind front end parts form arm coupling portions 51 that are separated from the narrow portion 46. The arm coupling portions 51 are slightly behind the lock 42 on left and right side surfaces of the lock arm body 41.

As shown in FIG. 2, the front surface of each arm 49 is substantially perpendicular to the front-rear direction. The lower surface of each arm 49 is inclined gradually up from the arm coupling portion 51 toward a rear side. A height (vertical dimension) of each arm 49 is reduced gradually from the arm coupling portion 51 toward the rear.

As shown in FIG. 1, the housing body 21 includes the protecting portion 29 for covering the lock arm 40 from above (side opposite to the unlocking direction). The protecting portion 29 includes two protecting legs 31 rising on the upper surface of the housing body 21 and a protecting wall 32 disposed between the upper ends of the protecting legs 31 to define a U-shape. The front ribs 28F and the rear ribs 28L are connected to the lower ends of the protecting legs 31.

The protecting portion 29 is located in an intermediate part of the lock arm body 41 in the front-rear direction and substantially aligned with the arm coupling portions 51 in the front-rear direction. The front surfaces of the pair of protecting leg portions 31 and those of the arm portions 49 are located at the same position in the front-rear direction. The pressing surface 43 is located behind the protecting portion 29 (see FIG. 2).

As shown in FIG. 6, the protecting wall 32 is provided with a recess 33 in an area corresponding to the pressing surface 43. The recess 33 is in a central part of the protecting wall 32 in the lateral direction. The recess 33 is formed by forwardly recessing the rear edge of the protecting wall 32 so that a dimension of the protecting wall 32 in the front-rear direction is smaller at the recess 33. Left and right end parts of the recess 33 form tapers 34 gradually recessed more from lateral ends toward a center. A lateral dimension of the recess 33 including the tapers 34 is equal to that of the pressing surface 43.

Next, an example of a separating operation of the connector is described.

In the properly connected state of the connector, the substantially front half of the housing body 21 is fit in the receptacle of the mating connector housing and the protecting portion 29 is proximate to the receptacle. Further, the terminal fitting 10 is connected conductively to the mating terminal fitting. A signal conductive path is formed by the contact of the inner conductor with the mating inner conductor and a shield conductive path is formed by the contact of the outer conductor 12 with the mating outer conductor.

The properly connected connector can be separated by placing fingers on the pressing surface 43 projecting rearward from the protecting portion 29 and pressing the pressing surface 43 down. The pressing surface 43 is on the rear part of the lock arm 40, and the wide pressing surface 43 is exposed upward. The rear end fixing portion 48 of the lock arm 40 enters the cutout 52 of the pressing surface 43 as the pressing surface 43 is pressed down. The coupling portion 44 and the central part of the lock arm body 41 are displaced down with the pressing surface 43. In this way, the locking portion 42 is displaced down in the unlocking direction to release the locked state to the mating connector housing. The connector housing 20 then is pulled apart from the mating connector housing while keeping the pressing surface 43 pressed until the separating operation of the connector C is completed.

The connector housing 20 of this embodiment includes the housing body 21 to which the mating connector housing is to be fit from the front. The lock arm 40 has both end parts in the front-rear direction fixed to the housing body 21 and has the lock 42 in the central part in the front-rear direction. The lock 42 is configured to lock the mating connector housing. The pressing surface 43 is on the rear part of the lock arm 40 and can be pressed to displace the lock 42 in the unlocking direction. The coupling portion 44 couples the pressing surface 43 to the central part of the lock arm 40 in the front-rear direction. According to this configuration, the pressing surface 43 is on the rear part of the lock arm 40 and at a position distant from the receptacle of the mating connector housing. Thus, the lock arm 40 easily can be displaced in the unlocking direction by pressing the pressing surface 43, and the unlocking operation can be carried out easily.

The coupling portion includes the two arms 49 coupled to both left and right sides of the lock arm 40, and the pressing surface 43 extends to the arms 49. According to this configuration, the pressing surface 43 can be wide, and fingers easily can be placed on the pressing surface 43 so that the unlocking operation can be facilitated.

The pressing surface 43 has the cutout 52 configured to allow the rear end part of the lock arm 40 to escape when the pressing surface 43 is pressed. According to this configuration, the deflection space S for the lock arm 40 can be made smaller, and the connector housing 20 can be reduced.

The protecting portion 29 covers the intermediate part of the lock arm 40 from above (side opposite to the unlocking direction), and the pressing surface 43 is behind the protecting portion 29. Thus, the intermediate part of the lock arm 40 in the front-rear direction will not be pressed inadvertently, but the pressing surface 43 can be pressed easily.

The terminal fitting 10 accommodated in the housing body 21 is a coaxial terminal connected to the end of the coaxial cable. If a lock arm is cantilevered, a locking portion provided on a free end of the lock arm is displaced along an arcuate path with a fixed end as a support to be locked to a mating side. Thus, a predetermined clearance is necessary in a locking part and a connector in a properly connected state tends to rattle. If a coaxial connector largely rattles in a properly connected state, a characteristic impedance disturbance is caused, thereby presenting a problem of affecting a high frequency characteristic of the coaxial cable. However, according to this configuration, the lock arm 40 of the connector housing 20 is supported on both ends. Thus, the rattling of the connector in the properly connected state can be reduced to suppress a high frequency characteristic variation.

The invention is not limited to the above described and illustrated embodiment. For example, the following embodiments also are included in the scope of the invention.

The housing body 21 is fit into the receptacle of the mating connector housing in the above embodiment. However, the housing body can be fit externally to the mating connector housing.

The coupling portion 44 includes the two arms 49 coupled to the left and right sides of the lock arm 40 in the above embodiment. However, the coupling portion may be of any form as long as the coupling portion couples the pressing surface to the central part of the lock arm in the front-rear direction. For example, the pressing surface and the lock arm may be coupled by one arm.

Although the pressing surface 43 is formed with the cutout 52 in the above embodiment, the cutout may be omitted.

Although the housing body 21 includes the protecting portion 29 in the above embodiment, the protecting portion may not necessarily be provided.

Although the terminal fitting 10 is the coaxial terminal in the above embodiment, the terminal fitting may not necessarily be the coaxial terminal.

LIST OF REFERENCE SIGNS

C . . . connector
10 . . . terminal fitting
20 . . . connector housing
21 . . . housing body
29 . . . protecting portion
40 . . . lock arm
42 . . . lock
43 . . . pressing surface
44 . . . coupling portion
49 . . . arm
52 . . . cutout

What is claimed is:

1. A connector housing, comprising:

a housing body having a front end to which a mating connector housing is to be fit;

a lock arm having front and rear ends fixed to the housing body, opposite left and right sides extending between the front and rear ends and having a lock in a central part in a front-rear direction, the lock being configured to lock the mating connector housing;

a coupling portion having left and right arms coupled respectively to the opposite left and right sides of the lock arm at positions rearward of the lock in the front-rear direction and continuing toward the rear end of the lock arm;

a pressing surface extending between the left and right arms and continuing toward the rear end of the lock arm and disposed so that the lock arm is between the housing body and the pressing surface, the pressing surface being configured to displace the lock in an unlocking direction by being pressed toward the housing body; and a protecting portion fixed to the housing body and covering a side of the lock arm opposite to the unlocking direction, the protecting portion being rearward of the lock and forward of the pressing surface.

2. The connector housing of claim 1, wherein the pressing surface is formed with a cutout configured to allow the rear end part of the lock arm to escape when the pressing surface is pressed.

3. A connector, comprising:

the connector housing of claim 1; and a terminal fitting accommodated in the housing body.

4. The connector of claim 3, wherein the terminal fitting is a coaxial terminal to be connected to an end of a coaxial cable.

5. The connector housing of claim 1, wherein the coupling portion is coupled to a position on the lock arm between the lock and the rear end of the lock arm.

6. The connector housing of claim 1, wherein a front end of the protecting portion and a front end of the coupling portion are substantially aligned with one another in a front-rear direction.

7. The connector housing of claim 1, wherein areas of the lock arm adjacent the rear end of the lock arm are disposed between the housing body and the pressing surface.

* * * * *